US006900765B2

(12) United States Patent
Navarro et al.

(10) Patent No.: US 6,900,765 B2
(45) Date of Patent: May 31, 2005

(54) METHOD AND APPARATUS FOR FORMING MILLIMETER WAVE PHASED ARRAY ANTENNA

(75) Inventors: Julio A. Navarro, Kent, WA (US); John B. O'Connell, Seattle, WA (US); Richard N. Bostwick, Snoqualmie, WA (US)

(73) Assignee: The Boeing Company, Chicago, IL (US)

( * ) Notice: Subject to any disclaimer, the term of this patent is extended or adjusted under 35 U.S.C. 154(b) by 88 days.

(21) Appl. No.: 10/625,767

(22) Filed: Jul. 23, 2003

(65) Prior Publication Data

US 2005/0017904 A1 Jan. 27, 2005

(51) Int. Cl.[7] ..... H01Q 1/38
(52) U.S. Cl. ..... 343/700 MS; 343/776
(58) Field of Search ..... 343/700 MS, 776, 343/772, 850, 853

(56) References Cited

U.S. PATENT DOCUMENTS

| | | | | |
|---|---|---|---|---|
| 4,806,941 A | | 2/1989 | Knochel et al. | 343/700 MS |
| 5,008,678 A | | 4/1991 | Herman | 342/158 |
| 5,136,304 A | | 8/1992 | Peters | 343/777 |
| 5,219,377 A | | 6/1993 | Poradish | 333/247 |
| 5,276,455 A | | 1/1994 | Fitzsimmons et al. | 343/777 |
| 5,488,380 A | | 1/1996 | Harvey et al. | 343/700 MS |
| 5,557,291 A | * | 9/1996 | Chu et al. | 343/776 |
| 5,675,345 A | | 10/1997 | Pozgay et al. | 343/700 MS |
| 5,825,333 A | | 10/1998 | Kudoh et al. | 343/853 |
| 5,886,671 A | | 3/1999 | Riemer et al. | 343/776 |
| 5,923,289 A | * | 7/1999 | Buer et al. | 342/373 |
| 6,018,659 A | | 1/2000 | Ayyagari et al. | 455/431 |
| 6,297,774 B1 | * | 10/2001 | Chung | 343/853 |

FOREIGN PATENT DOCUMENTS

| | | |
|---|---|---|
| EP | 0 889 542 A1 | 1/1999 |
| EP | 0 889 543 A2 | 1/1999 |
| EP | 0 910 134 A2 | 4/1999 |
| JP | 10-270935 | 9/1998 |
| WO | WO 99/34477 | 7/1999 |
| WO | WO 02/09236 A2 | 1/2002 |

OTHER PUBLICATIONS

International Search Report dated Oct. 25, 2004.
PCT International Search Report filed Aug. 29, 2000.
Publication from Microwave Journal, Jan. 1994, entitled "A Connectorless Module for an EHF Phased–Array Antenna".

* cited by examiner

*Primary Examiner*—Wilson Lee
*Assistant Examiner*—Ephrem Alemu
(74) *Attorney, Agent, or Firm*—Harness Dickey & Pierce P.L.C.

(57) ABSTRACT

A phased array antenna system having a corporate waveguide distribution network stripline printed circuit board. The stripline printed circuit board receives electromagnetic (EM) wave energy from a 1×4 waveguide distribution network input plate and distributes the EM wave energy to 524 radiating elements. The stripline circuit board enables extremely tight spacing of independent antenna radiating elements that would not be possible with a rectangular air filled waveguide. The antenna system enables operation at millimeter wave frequencies, and particularly at 44 GHz, and without requiring the use of a plurality of look-up tables for various phase and amplitude delays, that would otherwise be required with a rectangular, air-filled waveguide distribution structure. The antenna system can be used at millimeter wave frequencies, and in connection with the MILSTAR communications protocol, without the requirement of knowing, in advance, the next beam hopping frequency employed by the MILSTAR protocol.

21 Claims, 6 Drawing Sheets

METHOD AND APPARATUS FOR FORMING MILLIMETER WAVE PHASED ARRAY ANTENNA

FIELD OF THE INVENTION

The present invention relates to antennas, and more particularly to an electronically scanned, dual beam phased array antenna capable of operating at millimeter wavelengths and incorporating a corporate stripline waveguide structure.

BACKGROUND OF THE INVENTION

A phased array antenna is composed of multiple radiating antenna elements, individual element control circuits, a signal distribution network, signal control circuitry, a power supply, and a mechanical support structure. The total gain, effective isotropic radiated power and scanning and side lobe requirements of the antenna are directly related to the number of elements in the antenna aperture, the element spacing, and the performance of the elements and element electronics. In many applications, thousands of independent element/control circuits are required to achieve a desired antenna performance. A typical phased array antenna includes independent electronic packages for the radiating elements and control circuits that are interconnected through an external distribution network. FIG. 1 shows a schematic of a typical transmit phased array antenna which includes an input, distribution network, element electronics and radiators.

As the antenna operating frequency increases, the required spacing between radiating elements decreases and it becomes difficult to physically configure the control electronics and interconnects within the increasingly tight element spacing. Relaxing the tight element spacing will degrade the beam scanning performance, but adequately providing multiple interconnects requires stringent manufacturing and assembly tolerances which increase system complexity and cost. Consequently, the performance and cost of the phased array antenna depends primarily on module packaging and distribution network interconnects. Multiple beam applications further complicate this problem by requiring more electronic components and interconnects within the same antenna volume.

Phased array packaging architectures can be divided into tile (i.e., coplanar) and brick (i.e., in-line) styles. FIG. 2 shows a typical tile-type architecture which exhibits components that are co-planar with the antenna aperture and which are assembled together as tiles. FIG. 3 shows a typical brick-type architecture which uses in-line components that are perpendicular to the antenna aperture and are assembled together similar to bricks.

The assignee of the present application, The Boeing Company, has been a leading innovator in phased array module/element packaging technology. The Boeing Company has designed, developed and delivered many phased arrays which use tile, brick and hybrid techniques to fabricate radiator modules and/or distribution networks. The RF distribution network which provides electromagnetic wave EM energy to each of the phased array modules can be delivered in what is called "series" or "parallel". Series distribution networks are often limited in instantaneous bandwidth because of the various delays which the EM wave signal experiences during the distribution. Parallel networks, however, provide "equal delay" to each of the modules, which allows wide instantaneous bandwidth.

However, parallel distribution increases in difficulty with a large number of radiator modules. The most common method to deliver equal delay to a group of phased array modules is a "corporate" distribution network. The corporate distribution network uses binary signal splitters to deliver equally delayed signals to $2^n$ modules. This type of distribution lends itself well to the tile array architecture that has been used extensively throughout industry.

The use of a corporate network in a tile architecture is limited by the module spacing. It becomes increasingly more difficult to distribute EM wave energy, DC power signals, and logic signals with tightly-packed modules of wide-angle beam scanning arrays at higher operating frequencies. Because the cost of RF power also increases with operating frequency, designers try to limit distribution losses by using low-loss transmission media. The lowest loss medium used is an air filled rectangular waveguide. However, such a waveguide requires a large volume and is not easily routed to individual sites (i.e., antenna modules). Stripline conductors, depending on material parameters and dimensions, can exhibit as much as 5–10 times the amount of loss per unit length of waveguide as an air filled rectangular waveguide. However, a stripline waveguide is very compact and readily able to distribute RF energy to tightly-packed modules (i.e., radiating elements) that are separated by only a very small amount of spacing.

Air filled waveguides can be used exclusively in a series network to feed tightly packed antenna modules. Each air filled length of waveguide uses a series of slots in what is referred to as a "rail". The electrical length between the slots in a rail changes with the operating frequency. If the rail is used to form an antenna beam, the change in electrical length between slots causes the beam to shift or "squint" away from the intended angle as the operating frequency changes. As the number of slots in the rail is increased, the beam squint becomes more pronounced, thus reducing the instantaneous bandwidth even further. The slots in a rail also tend to interact with each other and make rail designs more difficult and complex. If the slots were isolated from each other, then the length of each slot needed for the desired coupling levels could be more easily determined. A rail also achieves its desired phase and amplitude distribution at a single center frequency and quickly degrades as the operating frequency deviates away from the center frequency.

For a phased array antenna, the phase errors introduced by series distribution networks can be adjusted for in the antenna module using phase shifters. To accomplish the adjustment or calibration, a priori knowledge of the instantaneous operating frequency is required. A look-up table is used to correct for the beam squint at various frequency points along the operating bandwidth of the array. The length of the rail determines the number of steps or increments required to adequately adjust the phase shifters. Longer rails cause more beam squint and narrower instantaneous bandwidth, which means that more frequency increments are required to calibrate the numerous antenna modules of the antenna.

A particularly challenging problem that The Boeing Company has been faced with, and which the antenna and method of the present invention overcomes, is developing a wide-beam scanning, Q-band phased array antenna capable of operating at 44 GHz for MILSTAR communications. The MILSTAR communication protocol uses narrowband bursts of information frequency hopping over the 2 GHz bandwidth of operation. However, the use of a series fed waveguide and the differing beam squints requires knowledge of the next beam hopping frequency so that the appropriate delay can be obtained from the look-up table and applied to the phase shifters. Without such knowledge of the next beam hopping frequency, the series fed beam rail squints cannot be accurately determined. For security reasons, it is desirable for a phased array antenna system to not require specific frequency information for operation but instead to be able to operate over the entire bandwidth as a passive device. A new form of corporate feed waveguide network is therefore required which allows very tight module spacing, but which still does not require individual series led rail beams squints to be calculated to maintain calibration of all of the individual module elements of the antenna.

SUMMARY OF THE INVENTION

The present invention is directed to a phased array antenna system and method which is capable of operating at 44 GHz and in accordance with the MILSTAR communication protocol without advance knowledge of the next beam hopping frequency. The system and method of the present invention accomplishes this by providing a phased array antenna incorporating the use of a new waveguide network. A first air filled waveguide structure feeds electromagnetic wave (EM) input energy into a second, dielectrically-filled waveguide structure. The second, dielectrically-filled waveguide structure feeds EM wave energy into a corporate stripline waveguide network. The corporate stripline waveguide network distributes the EM wave energy to a plurality of radiating elements of each of a corresponding plurality of independent antenna modules making up the phased array antenna of the present invention.

In one preferred form the first waveguide structure comprises a rectangular air waveguide structure. This structure feeds EM wave input energy from an input thereof into a plurality of outputs and divides the EM wave energy among the plurality of outputs. These outputs feed the second waveguide structure which, in one preferred form, includes a plurality of dielectrically-filled circular waveguides. The second waveguide structure channels the EM wave energy to a corresponding plurality of inputs of the stripline waveguide structure where this EM wave energy is further successively divided before being applied to each of the radiating elements of the plurality of antenna modules of the antenna system. The use of the corporate stripline waveguide structure allows extremely tight element spacing to be achieved with only a very small reduction in efficiency of the system. The use of the corporate stripline waveguide structure further eliminates the need to apply independent beam squint corrections that would necessitate knowing the next beam hopping frequency in a MILSTAR application. The use of the corporate stripline waveguide network, in connection with the use of the first and second waveguide structures and suitable phase shifters, effectively provides the same delay to each radiating element of the antenna system, which also significantly simplifies the complexity of the electronics needed for the antenna system.

Advantageously, the antenna system of the present invention is calibrated using a single look-up table; therefore, a priori knowledge of the next beam hopping frequency is not needed. The antenna system of the present invention provides excellent beam side lobe levels at both boresight and at a 60 degree scan angle. The beam patterns produced by the antenna system of the present invention also exhibit excellent cross-polarization levels.

Further areas of applicability of the present invention will become apparent from the detailed description provided hereinafter. It should be understood that the detailed description and specific examples are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 6 is a plan view of the waveguide distribution network input plate which forms a 1×4 air filled rectangular waveguide feed structure;

DETAILED DESCRIPTION OF THE PREFERRED EMBODIMENTS

The following description of the preferred embodiment(s) is merely exemplary in nature and is in no way intended to limit the invention, its application, or uses.

Figure 1:
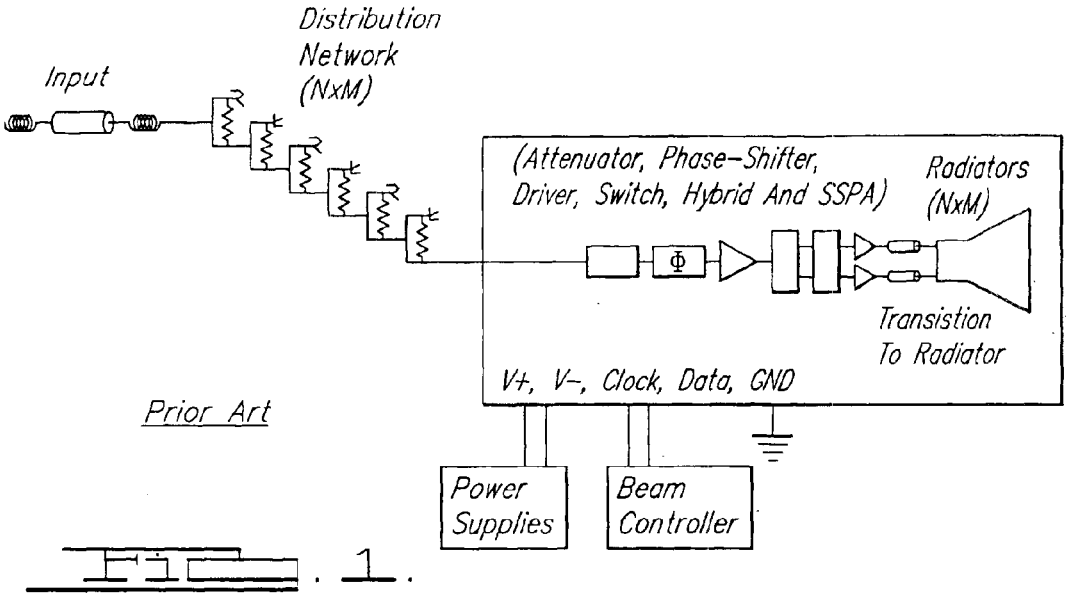
FIG. 1 is a simplified block diagram of a typical transmit phased array antenna system.
Figure 2:
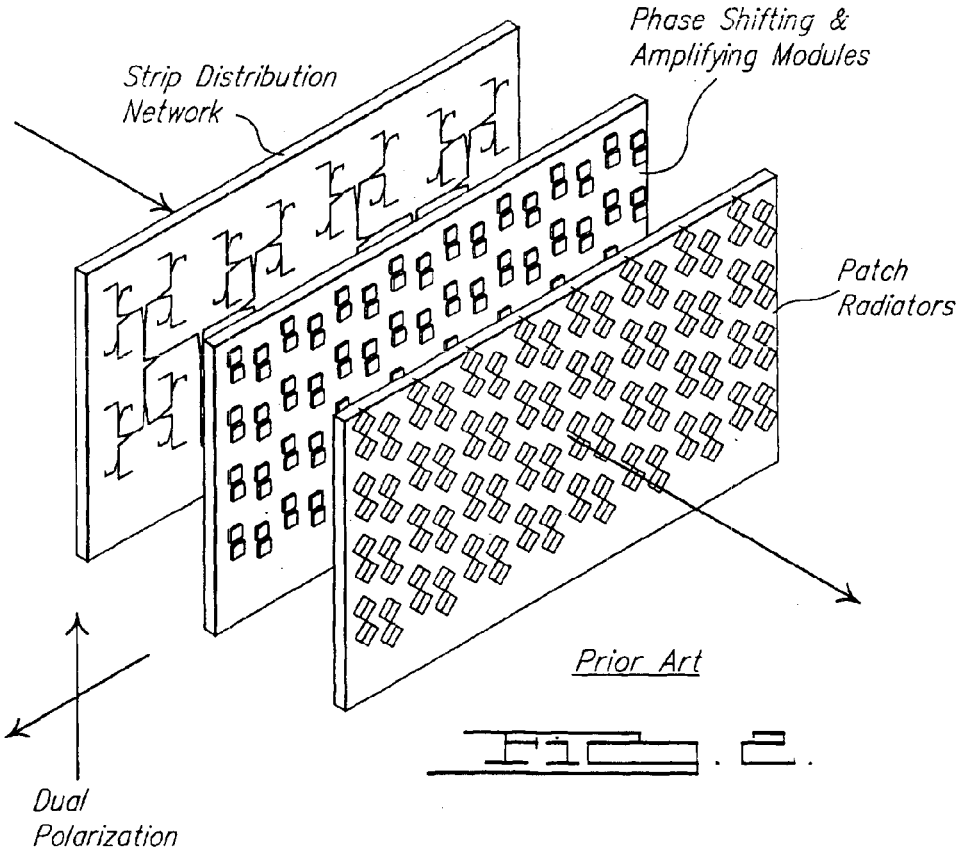
FIG. 2 is a simplified perspective view of certain of the components of a tile-type phased array antenna system.
Figure 3:
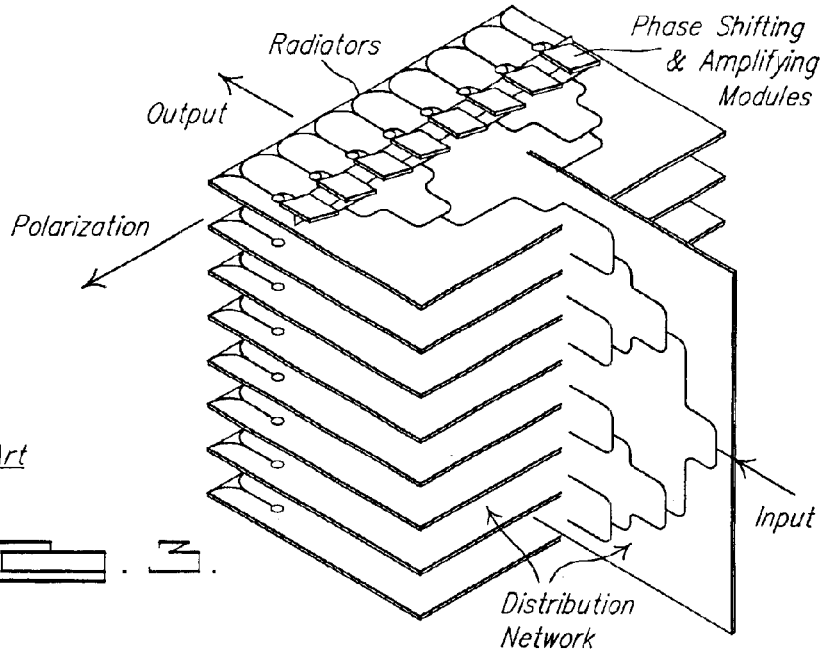
Prior Art FIG. 3.
FIG. 3 is a simplified perspective view of certain components of a brick-type phased array antenna system.
Figure 4:
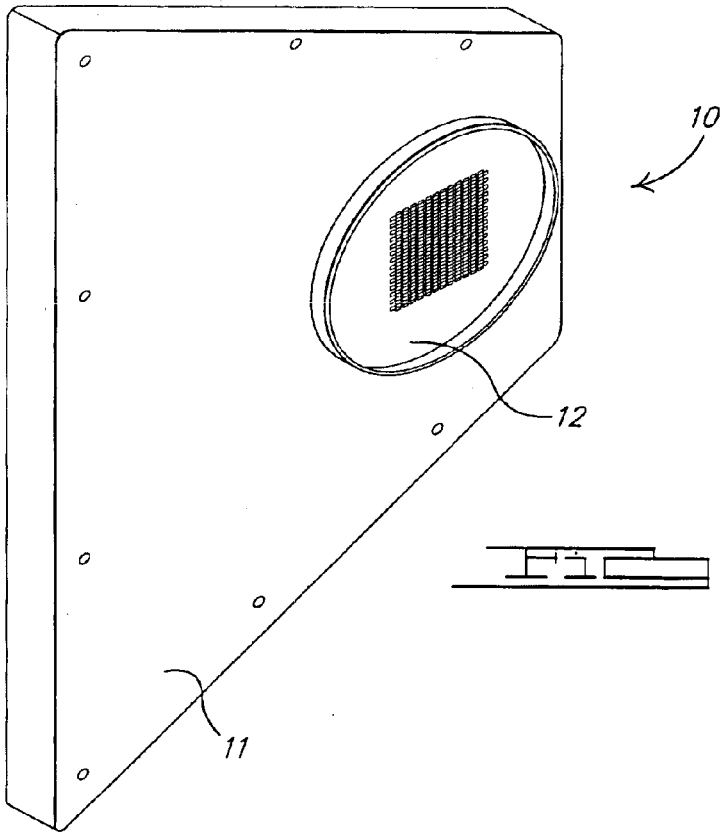
FIG. 4 is a simplified perspective view of a phased array antenna in accordance with a preferred embodiment of the present invention.

Referring to FIG. 4, an antenna system 10 in accordance with a preferred embodiment and method of the present invention is shown. The antenna system 10 forms an antenna able to operate at millimeter wavelengths, and more particularly at 44 GHz (Q-band) and in accordance with the MILSTAR protocol without requiring advance knowledge of the next beam hopping frequency being employed in a MILSTAR application. The antenna system 10 forms a dual beam system having a plurality of 524 independent antenna modules very closely spaced relative to one another to enable operation at millimeter wave frequencies, and more preferably at about 44 GHz, without suffering significant beam degradation and performance at scan angles up to (or exceeding) 60 degrees. The antenna system generally includes a chassis 11 within which is supported a feed network 12 and associated electronics (not shown).

Figure 5A:
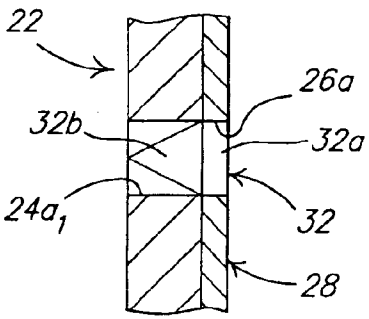
FIG. 5A is a partial cross-sectional view of a tapered transition dielectric plug inserted within the tapered transmission plate and the WDN feed plate.
Figure 5:
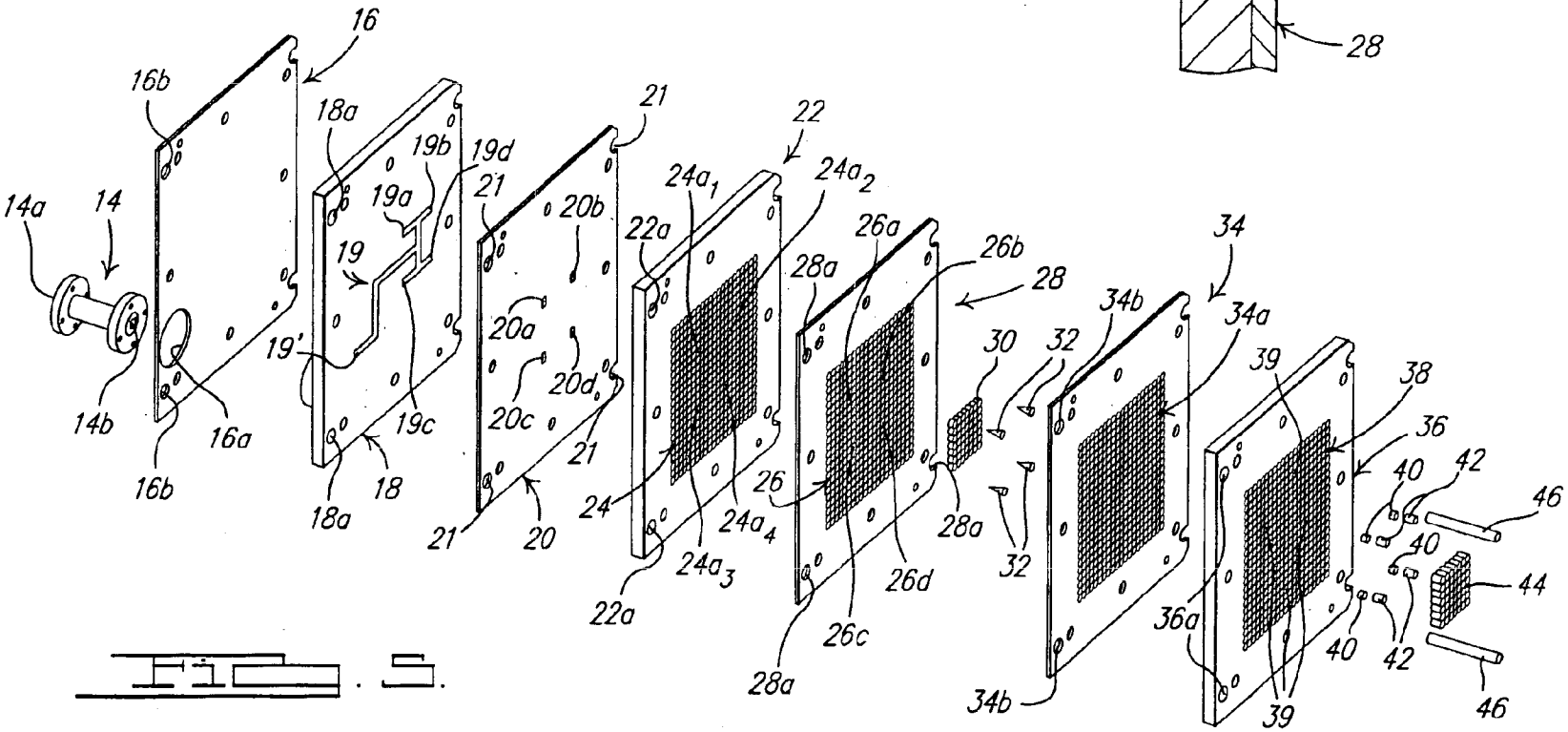
FIG. 5 is an exploded perspective view of the antenna system feed network of FIG. 4.

Referring to FIG. 5, an exploded perspective view of the major components of the feed network 12 of the antenna system 10 is illustrated. The EM wave input signal is generated by a microwave generator (not shown) to an input end 14*a* of a waveguide input transition member 14. The EM wave signal travels through a rectangular bore to a rectangular output 14*b*. The waveguide input transition member 14 is inserted through an aperture 16*a* in a rear, mechanical, co-thermal spacer plate 16 and the output 14*b* is connected to a waveguide distribution network (WDN) input plate 18. The WDN input plate 18 has a waveguide 19 having an input 19' and outputs 19*a*–19*d*. The WDN input plate 18 is coupled to a bottom rectangular feed plate 20 having a plurality of four rectangular waveguide slots 20*a*–20*d* that align with outputs 19*a*–19*d*. The EM wave input signals are channeled from the WDN input plate 18 through waveguide 19, through slots 20*a*–20*d* and into a WDN tapered transmission plate 22. Transmission plate 22 has a plurality of 524 generally circular recesses 24 that do not extend completely through the thickness of plate 22. Plate 22 also includes four apertures $\mathbf{24}a_1$–$\mathbf{24}a_4$ that extend completely through the plate 22. The four apertures $\mathbf{24}a_1$–$\mathbf{24}a_4$ are aligned with the four waveguide slots 20*a*–20*d*. Each one of the 524 recesses 24 and four apertures $\mathbf{24}a_1$–$\mathbf{24}a_4$ are longitudinally aligned with a corresponding plurality of apertures 26 in a WDN feedplate 28. A plurality of 524 ¼ wave, circular backshort dielectric plugs 30 (shown merely as a representative plurality in FIG. 5) fill 524 of the apertures 26 and also fill 524 of the apertures 24 of transmission plate 22. A plurality of four tapered transition dielectric plugs 32 extend through four of the apertures 26*a*–26*d*. The apertures 26 filled by tapered transition dielectric plugs 32 are those apertures that are longitudinally aligned with apertures $\mathbf{24}a_1$–$\mathbf{24}a_4$ of tapered transmission plate 22 and rectangular slots 20*a*–20*d* of rectangular feed plate 20. Dielectric plugs 32 also extend partially into apertures $\mathbf{24}a_1$–$\mathbf{24}a_4$ when the feed network 12 is fully assembled. This is illustrated in FIG. 5*a* where plug 32 can be seen to have a circular head portion 32*a* and a conical body portion 32*b*. The circular head portion 32*a* fills an associated aperture (i.e., one of apertures 26*a*–26*d*) in the WDN feedplate 28 and the conical body portion 32*b* rests within an associated one of the apertures $\mathbf{24}a_1$–$\mathbf{24}a_4$ in the WDN tapered transmission plate 22.

The apertures $\mathbf{24}a_1$–$\mathbf{24}a_4$ in the WDN tapered transmission plate 22 begin as rectangular in cross section on the back side of transmission plate 22 (i.e., the side not visible in FIG. 5), and transition into a circular cross sectional shape on the side visible in FIG. 5. This, together with the conical portions of plugs 32, serves to provide a rectangular-to-circular waveguide transition area for the EM wave energy traveling through the plate 22. In one preferred form plugs 32 have a dielectric constant of preferably about 2.5. Accordingly, WDN transmission plate 22 functions as a rectangular-to-circular waveguide transitioning component.

With further reference to FIG. 5, a WDN stripline printed circuit board (PCB) 34 is secured over an output side of WDN feedplate 28 and forms a means for dividing the EM wave energy channeled through each of the four apertures 24*a* to a corresponding input trace of a corporate stripline distribution network 34*a* formed on the WDN stripline PCB 34. A WDN circular waveguide plate 36 is secured over the WDN stripline PCB 34. WDN circular waveguide plate 36 includes 528 circular apertures, designated generally by reference numeral 38, with four apertures 39 each filled with one circular backshort dielectric plug 40 and one circular backshort aluminum (conductive) plug 42. The filled apertures 39 are those that are longitudinally aligned with slots 20*a*–20*d* of rectangular feed plate 20 and apertures $\mathbf{24}a_1$–$\mathbf{24}a_4$ of tapered transmission plate 22. The remaining 524 apertures denoted by reference numeral 38 are filled with circular waveguide dielectric plugs 44 (shown merely as a representative plurality in FIG. 5). Plugs 44 preferably are comprised of Rexolite® plastic. A pair of module alignment pins 46 extend through apertures 36*a* in waveguide plate 36, apertures 34*b* in WDN stripline circuit board 34, apertures 28*a* in feed plate 28, apertures 22*a* in tapered transition plate 22, apertures 21 in rectangular feed plate 20, apertures 18*a* in WDN input plate 18 and apertures 16*b* in spacer plate 16 to maintain alignment of the large plurality of apertures of the components 22, 28, 34 and 36 illustrated in FIG. 5.

With brief reference to FIG. 6, the WDN input plate 18 can be seen in greater detail. WDN input plate 18 includes the rectangular, air-filled waveguide 19 having input 19' that receives EM wave energy from the output end 14*b* of waveguide input transition 14 of FIG. 5. The rectangular, air-filled waveguide 19 takes this EM wave input energy and divides it between the four rectangular output slots 19*a*, 19*b*, 19*c*, and 19*d*. The EM wave energy exiting through rectangular slots 19*a*–19*d* is channeled through rectangular slots 20*a*–20*d* of WDN bottom rectangular feed plate 20 shown in FIG. 5. WDN input plate 18 is preferably formed from a single sheet of metal, and more preferably from aluminum, although it will be appreciated that other suitable metallic materials such as gold could be employed. Spacer plate 16 is also preferably formed from metal, and more preferably aluminum, as are plates 22, 28 and 38.

Figure 7:
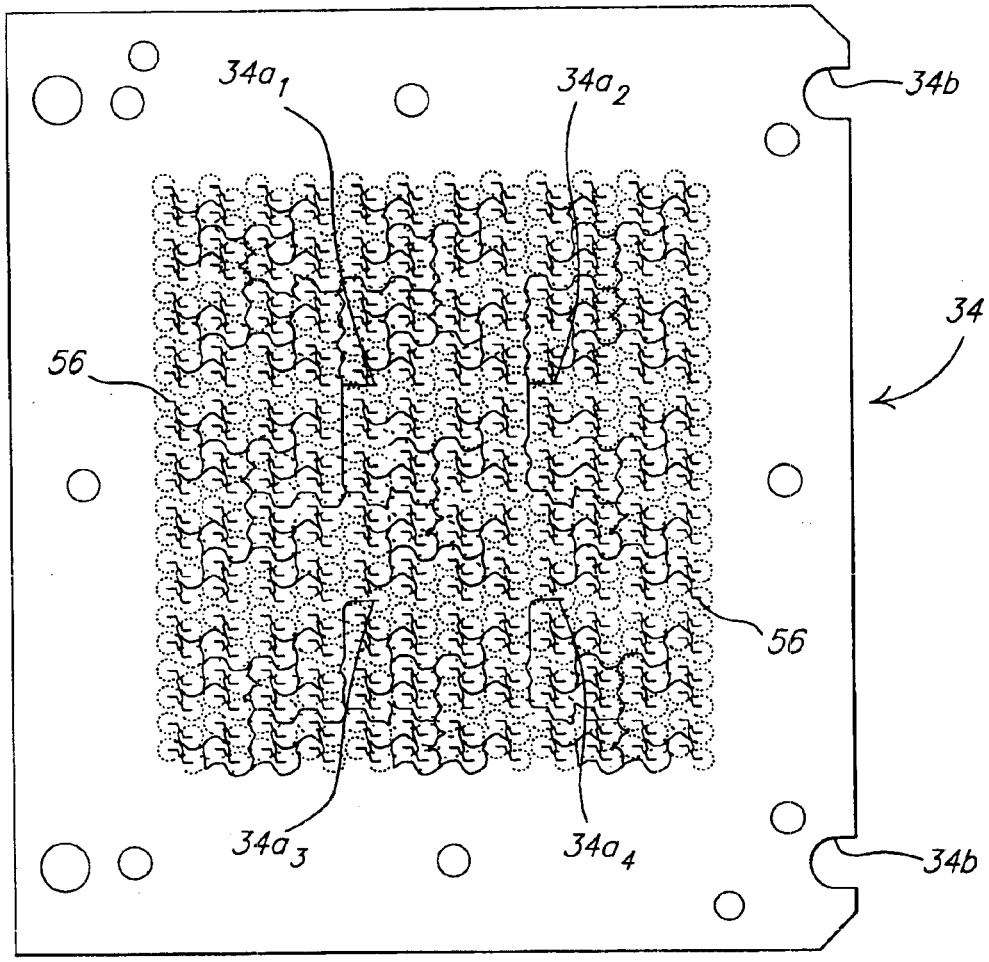
FIG. 7. Is an enlarged plan view of the stripline waveguide printed circuit board.
Figure 5:
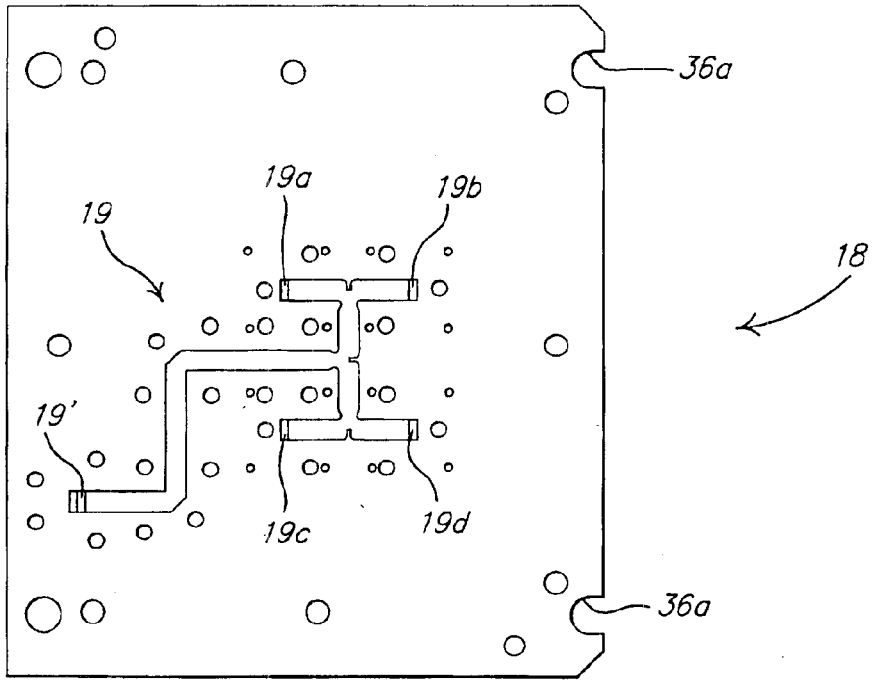
Figure 8:
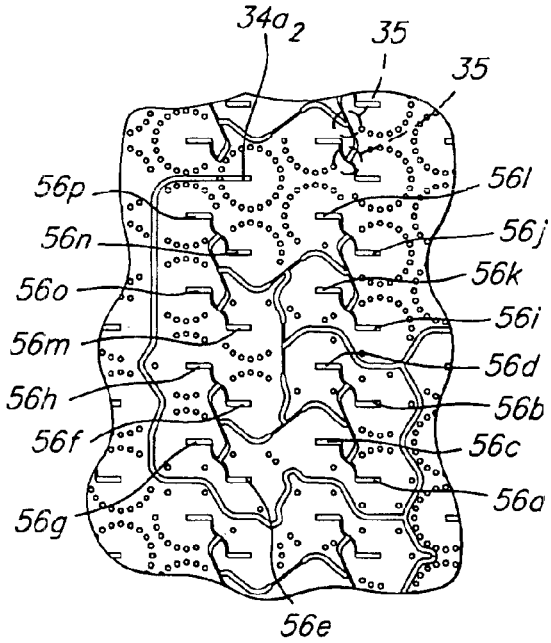
FIG. 8 is a highly enlarged portion of the circuit board of FIG. 7.

FIG. 7 is a plan view of the stripline printed circuit board 34. Input traces $\mathbf{34}a_1$, $\mathbf{34}a_2$, $\mathbf{34}a_3$ and $\mathbf{34}a_4$ are aligned with apertures $\mathbf{24}a_1$–$\mathbf{24}a_4$ of the waveguide tapered transition plate 22, respectively. More specifically, the input traces $\mathbf{34}a_1$–$\mathbf{34}a_4$ are each disposed to line up parallel with the electromagnetic field in each of apertures 26*a*–26*d*. Inputs $\mathbf{34}a_1$–$\mathbf{34}a_4$ each feed a plurality of EM wave radiating elements 56 (i.e., independent antenna modules) through a plurality of "T-junctions" 35 (denoted in FIG. 8) formed by the conductive portions (i.e., stripline traces) of the circuit board 34. More specifically, each of the "T-junctions" 35 of the WDN stripline PCB 34 operate as binary signal splitters to successively (and evenly) divide the EM wave input energy received at each of inputs $\mathbf{34}a_1$–$\mathbf{34}a_4$ into smaller and smaller subpluralities that are eventually applied to each radiating element 56. FIG. 8 illustrates a representative portion of the corporate EM wave distribution network formed by the stripline PCB 34. Input $\mathbf{34}a_2$ can be seen to feed radiating elements 56*a*–56*p*. Two representative T-junctions 35 are shown in FIG. 8.

Input $\mathbf{34}a_1$ feeds 254 of the radiating elements 56, input $\mathbf{34}a_2$ feeds 126 of the radiating elements 56, input $\mathbf{34}a_3$ feeds 96 of the radiating elements 56 and input $\mathbf{34}a_4$ feeds 48 of the radiating elements 56.

In operation, EM wave energy is radiated by each of the radiating elements 56 through the apertures 38 in the WDN circular waveguide plate 36, and also back towards the WDN feed plate 28. The plugs 30 have a preferred dielectric constant of about 2.5. Electromagnetic energy travels through plugs 30 and is reflected at the very bottom wall of each of the 524 recesses in transmission plate 22 back toward circuit board 34 and continuing on through apertures 38 in WDN circular waveguide plate 36. In one preferred form plugs 30 are made from Rexolite® plastic material. Plugs 40, which are preferably comprised of Rexolite® plastic, as well as plugs 42, which are preferably metal, and more preferably aluminum, fill apertures 39. The EM wave energy from apertures 26*a*–26*d* travels through plugs 40 and is reflected by plugs 42 back towards input traces $\mathbf{34}a_1$–$\mathbf{34}a_4$ of the circuit board 34. Plugs 30, 32, 40 and 44 each have a dielectric constant of preferably about 2.5 and enable operation of the antenna system 10 at millimeter wave frequencies with the very tight element spacing used in the antenna system.

Figure 9:
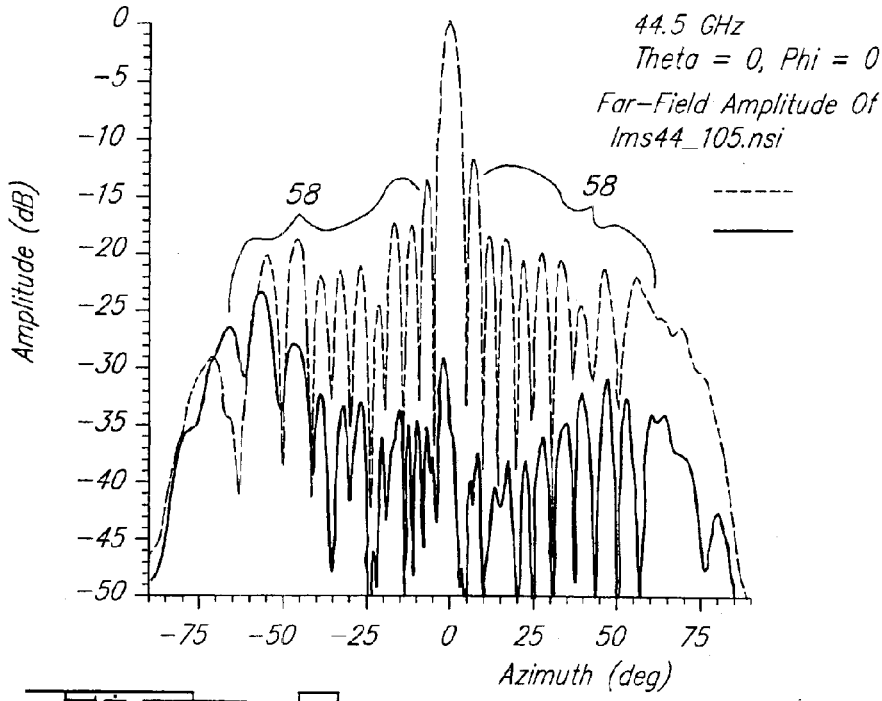
FIG. 9 is a graph of the far-field amplitude of the antenna of the present invention at a zero degree scan angle (i.e., along the boresight)
Figure 10:
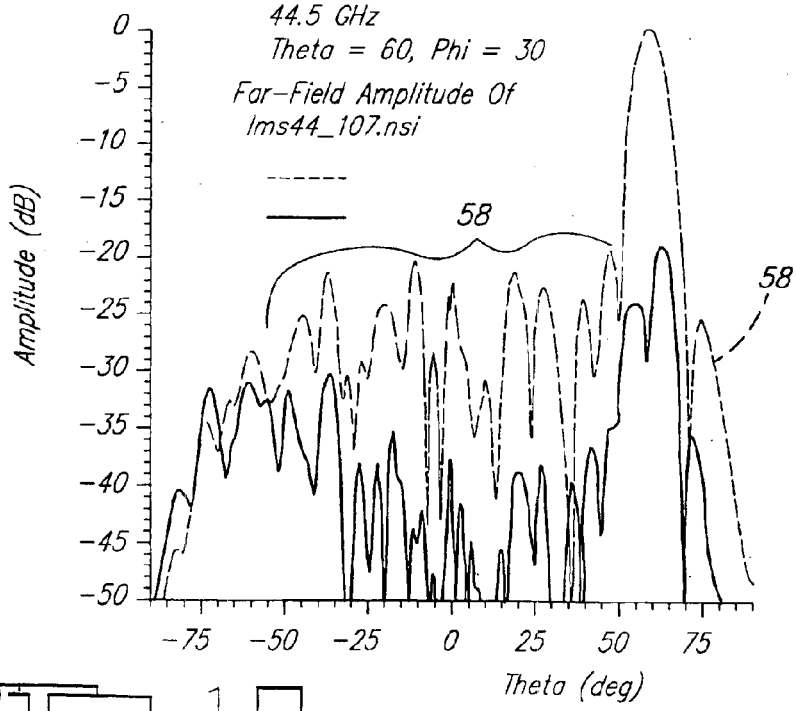
FIG. 10 is a graph of the far-field amplitude of the antenna system of the present invention at a 60 degree scan angle.

With brief reference to FIGS. 9 and 10, the performance of the antenna system of the present invention can be seen. Referring specifically to FIG. 9, the far-field performance of the antenna system 10 can be seen with the antenna system operating at 44.5 GHz and at a zero degree scan angle. Referring to FIG. 10, the antenna system 10 is shown operating at 44.5 GHz but with a 60 degree scan angle. The resulting sidelobe levels, represented by reference numerals 58, are well within acceptable limits and the beams shown in FIGS. 9 and 10 exhibit good cross-polarization levels. Performance is similar across a design bandwidth of 43.5–45.5 GHz.

The antenna system 10 of the present invention thus enables a phased array antenna to be formed with the radiating elements 56 being very closely spaced to one another to be able to perform at millimeter wave frequencies, and more particularly at 44 GHz. Importantly, the antenna system 10 does not require knowledge of the next beam hopping frequency when used in a MILSTAR communications protocol. The corporate WDN stripline printed circuit board 34 of the antenna system 10 enables the extremely close radiating element 56 spacing needed for excellent antenna performance at millimeter wave frequencies while allowing the amplitude and phased delays applied to each radiating element 56 to be determined from a single look-up table.

It will also be appreciated that while the terms "input" and "output" have been used to describe portions of the components of the antenna system 10, that this has been done with the understanding that the antenna has been described in a transmit mode of operation. As one skilled in the art will readily understand, these terms would be reversed when the antenna system 10 is operating in a receive mode.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. A phased array antenna, comprising:

a first dielectric filled waveguide structure for dividing an input of electromagnetic (EM) wave energy into a first plurality of EM wave signals;

a second dielectric filled waveguide structure disposed adjacent said first dielectric filled waveguide structure having a plurality of dielectric filled waveguides for receiving each of said first plurality of EM wave signals and channeling said first plurality of EM wave signals toward an output end of each one of said plurality of dielectric filled waveguides; and a stripline waveguide circuit board positioned adjacent said second dielectric filled waveguide structure and having circuit traces forming a plurality of inputs overlaying said output ends of said dielectric filled waveguides, said stripline waveguide circuit board distributing said EM wave signals via said circuit traces to a plurality of closely spaced EM wave radiating elements.

2. The phased array antenna of claim 1, wherein said first dielectric waveguide structure forms a 1×4 dielectric filled waveguide structure.

3. The phased array antenna of claim 1, wherein said second dielectric filled waveguide structure comprises a plurality of generally circular dielectric filled waveguides.

4. The phased array antenna of claim 1, wherein said stripline waveguide circuit board comprises a plurality of binary signal splitters for equally distributing EM wave energy from said EM wave signals to each of said EM wave radiating elements.

5. A phased array antenna, comprising:

a first dielectric filled waveguide structure for dividing an input of electromagnetic (EM) wave energy into a first plurality of EM wave signals;

a second dielectric filled waveguide structure having a plurality of dielectric filled, generally circular waveguides for receiving each of said first plurality of EM wave signals at inputs ends thereof and channeling said first plurality of EM wave signals toward output ends of said plurality of dielectric filled waveguides; and a stripline waveguide distribution circuit disposed generally parallel to and adjacent said second dielectric filled waveguide structure for receiving said EM wave signals and further dividing and further distributing EM wave energy therefrom to a plurality of EM wave radiating elements.

6. The phased array antenna of claim 5, wherein said stripline waveguide distribution circuit comprises a plurality of signal traces forming signal paths, with a plurality of input traces of said signal traces communicating with said generally circular waveguides to receive and channel said EM wave signals into said stripline wave guide distribution circuit.

7. The phased array antenna of claim 5, wherein said first dielectric filled waveguide structure forms a 1×4 corporate waveguide structure.

8. The phased array antenna of claim 5, wherein said stripline waveguide distribution circuit comprises a plurality of binary signal splitters for dividing said EM wave signals as said EM wave signals are routed through said stripline waveguide distribution circuit.

9. The phased array antenna of claim 5, wherein said first dielectric filled waveguide structure comprises an air filled rectangular waveguide.

10. A millimeter wave phased array antenna comprising:

a corporate waveguide feed for evenly dividing an input electromagnetic (EM) wave signal to a sub-plurality of EM wave signals;

a dielectric filled waveguide structure forming a plurality of generally circular, dielectric filled waveguides for receiving said sub-plurality of EM wave signals and channeling said sub-plurality of EM wave signals to output ends of said dielectric filled waveguides; and a stripline waveguide structure overlaying said dielectric filled waveguide structure for further dividing and distributing EM wave energy from said EM wave signals to a plurality of radiating elements.

11. The antenna of claim 10, wherein said corporate waveguide structure comprises a 1×4, air filled corporate waveguide feed.

12. The antenna of claim 10, wherein said stripline waveguide structure includes a plurality of input traces each electrically coupled with an associated one of said generally circular dielectric filled waveguides.

13. The antenna of claim 10, wherein said stripline waveguide structure comprises a plurality of binary signal splitters for dividing said EM wave signals prior to applying said EM wave signals to said radiating elements.

14. A method for forming a phased array antenna, comprising:

using a corporate waveguide feed for evenly dividing an input electromagnetic (EM) wave signal to a plurality of EM wave signals;

channeling said plurality of EM wave signals through a plurality of dielectric filled waveguides; and using a stripline waveguide in communication with said dielectric filled waveguides for further dividing and distributing said EM wave energy to a plurality of radiating elements.

15. The method of claim 14, wherein using a corporate waveguide comprises using a 1×4 corporate waveguide for evenly dividing said EM wave signal into a plurality of four EM wave signals.

16. The method of claim 14, wherein using a stripline waveguide comprises using a plurality of binary signal splitters to further evenly divide said sub-plurality of EM wave signals to a plurality of antenna radiating elements.

17. A method of using a phased array antenna, comprising:

generating an electromagnetic (EM) wave input signal;

directing said EM wave input signal into an input of a corporate waveguide wherein said EM wave input signal is divided into a first sub-plurality of EM wave signals;

channeling said first sub-plurality of EM wave signals into a dielectric filled waveguide structure having a corresponding plurality of dielectric filled waveguides;

coupling said first sub-plurality of EM wave signals into a stripline waveguide structure wherein said EM wave energy of said first sub-plurality of EM wave signals is further successively divided into a second sub-plurality of EM wave signals; and applying said second sub-plurality of EM wave signals to a corresponding plurality of antenna elements.

18. The method of claim 17, wherein coupling said first sub-plurality of EM wave signals into a dielectric filled waveguide structure further comprises using a plurality of binary signal splitters to successively divide said first sub-plurality of EM wave signals.

19. The method of claim 17, wherein using said corporate waveguide comprises using a 1×4 corporate waveguide.

20. The method of claim 17, wherein channeling said first sub-plurality of EM wave signals into a dielectric filled waveguide structure comprises channeling said first sub-plurality of EM wave signals in generally circular, dielectric filled waveguides.

21. A method of forming a phased array antenna for use with a MILSTAR communications protocol at millimeter wave frequencies without the need to know future beam hopping frequencies used in the implementation of said MILSTAR communications protocol, the method comprising:

generating an electromagnetic (EM) wave input signal;

routing said EM wave input signal through an air filled corporate waveguide so that the EM wave input signal is divided into a first sub-plurality of EM wave signals;

coupling said first sub-plurality of EM wave signals into a stripline waveguide structure disposed generally parallel relative to said air filled corporate waveguide, and including a plurality of EM wave radiating elements, wherein said EM wave energy is further successively divided into a second sub-plurality of EM wave signals; and using said stripline waveguide structure to route said second sub-plurality of EM wave signals to said EM wave radiating elements.

* * * * *